US006481797B1

(12) United States Patent
Ambrosio et al.

(10) Patent No.: US 6,481,797 B1
(45) Date of Patent: Nov. 19, 2002

(54) POWER-DRIVEN ARMCHAIR WITH AN IMPROVED STRUCTURE

(76) Inventors: Clara Ambrosio, Strada Padana Superiore, 39/A, 20065 Inzago (Milano) (IT); Carlo Bossoni, Viale Legioni Romane, 26, 20147 Milano (IT); Marco Parrini, Viale Gian Galeazzo, 7, 20136 Milano (IT)

( * ) Notice: Subject to any disclaimer, the term of this patent is extended or adjusted under 35 U.S.C. 154(b) by 0 days.

(21) Appl. No.: 09/554,902

(22) PCT Filed: Nov. 13, 1998

(86) PCT No.: PCT/EP98/07340

§ 371 (c)(1),
(2), (4) Date: May 19, 2000

(87) PCT Pub. No.: WO99/26518

PCT Pub. Date: Jun. 3, 1999

(30) Foreign Application Priority Data

Nov. 21, 1997 (IT) ..... MI97A2591

(51) Int. Cl.[7] ..... A47C 1/035
(52) U.S. Cl. ..... 297/330; 297/83; 297/316
(58) Field of Search ..... 297/313, 316, 297/320, 321, 322, 330, 68, 83

(56) References Cited

U.S. PATENT DOCUMENTS

| | | | | |
|---|---|---|---|---|
| 3,338,632 A | * | 8/1967 | Kleinsorge | 297/330 |
| 4,572,573 A | * | 2/1986 | Yoshikawa et al. | 297/330 |
| 4,637,652 A | * | 1/1987 | Bergenwall | 297/330 |
| 4,937,900 A | * | 7/1990 | Bridges | 297/330 |
| 5,790,997 A | * | 8/1998 | Ruehl | 297/316 |

* cited by examiner

*Primary Examiner*—Peter R. Brown
(74) *Attorney, Agent, or Firm*—Shlesinger, Fitzsimmons & Shlesinger

(57) ABSTRACT

An armchair (10) comprises a support frame (11, 12) to which a base seat (14) and a back (16) are fastened, which elements are movable between a first and a second position through power-driven movement means (21). The base seat (14) is pivotally mounted, at the front, to the support frame according to a first transverse axis (15). The back (16) is pivotally mounted to the base seat, at the rear thereof, according to a second transverse axis (17) for rotation of the back itself. The back (16) has extensions (18) extending downwardly past said second axis (17) and having ends constrained to slide longitudinally of the armchair. In this manner, on rotation of the back about said second axis (17), the base seat rotates in the same way about said first axis (15).

10 Claims, 2 Drawing Sheets

POWER-DRIVEN ARMCHAIR WITH AN IMPROVED STRUCTURE

The present invention relates to an innovatory armchair structure of the type provided with a base seat, a back and, optionally, a footrest, which elements are movable through electric motors.

Well known in the art are armchairs having a footrest and a back adapted to be drivingly inclined by means of electric motors.

Motors mounted on the fixed frame of the armchair have one rotation shaft close to the back and the other close to the footrest. Crank mechanisms connect each rotation shaft to the respective element (back or footrest) to be moved.

Usually, the rear shaft controls movement of the back, whereas the front shaft simultaneously controls movement of the footrest and the base seat, in terms of lifting the base seat (pivotally mounted, at the back, to the fixed frame) at the front, as the footrest itself moves upwardly.

For movement transmission, kinematic connecting rod-crank mechanisms connect the rear shaft to the back and the front shaft to the footrest and the base seat.

This structure is rather complicated, relatively expensive and bulky.

In addition, the inclination movement of the base seat should have to be used for maintaining a given angle between the bust and the pelvis when the back is greatly inclined. However, since the base seat movement is only connected to the footrest movement, this effect cannot be reached if the footrest is left at its lowered position or at all events it is not completely raised. But, when the footrest is even only partly lowered there is the maximum requirement of keeping an angle between the seat base and the back for avoiding too much stress at the lumbar region.

In the opposite case too, if the footrest is wished to be raised leaving the back at its completely lifted position, too much stress may be caused at the lumbar region. In fact, since the base seat movement is connected to the footrest movement, by raising the footrest, the angle between the base seat and the back is simultaneously reduced. If the back is completely raised, this angle may become too small for a comfortable position.

A further undesirable effect present in the above-mentioned known art is that of having a distance between the front shaft and the footrest which increases on increasing of the base seat inclination, because the footrest is hinged on the front edge of the base seat and moves therewith, whereas the motor is fixed to the ground. As a result, the driving shaft must have a relatively high rotation angle for completely raising the footrest, so as to compensate for the progressive moving away of the hinging points of the kinematic connecting rod-crank transmission mechanism between the driving shaft and the footrest. <Kinematic connections are known also by DE-A-33 16 533, wherein a chair is provided with a spring to damp the downward movement of the seat, and by U.S. Pat. No. 3,936,929, showing a dental chair whose seat is pivotally connected to the support frame at the rear end, so as to tilt up the seat when the backrest is lowered.>

It is a general object of the present invention to eliminate the above mentioned drawbacks by providing a power-driven armchair having an innovatory kinematic movement structure.

In view of the above object, in accordance with the invention, an armchair structure has been devised in which the base seat is pivotally mounted, at the front, on the support frame according to a first transverse axis, on said base seat being pivotally mounted the back, at the rear, according to a second transverse axis for rotation of the back itself, the back having extensions extending downwardly past said second axis and having ends constrained to slide longitudinally of the armchair, power-driven means controlling rotation of the back about said second axis, so that on rotation of the back about said second axis, the base seat rotates in the same way about said first axis.

For better explaining the innovatory principles of the present invention and the advantages it offers over the known art, a possible embodiment of the invention applying these principles will be described hereinafter, with the aid of the accompanying drawings. In the drawings.

Figure 1:
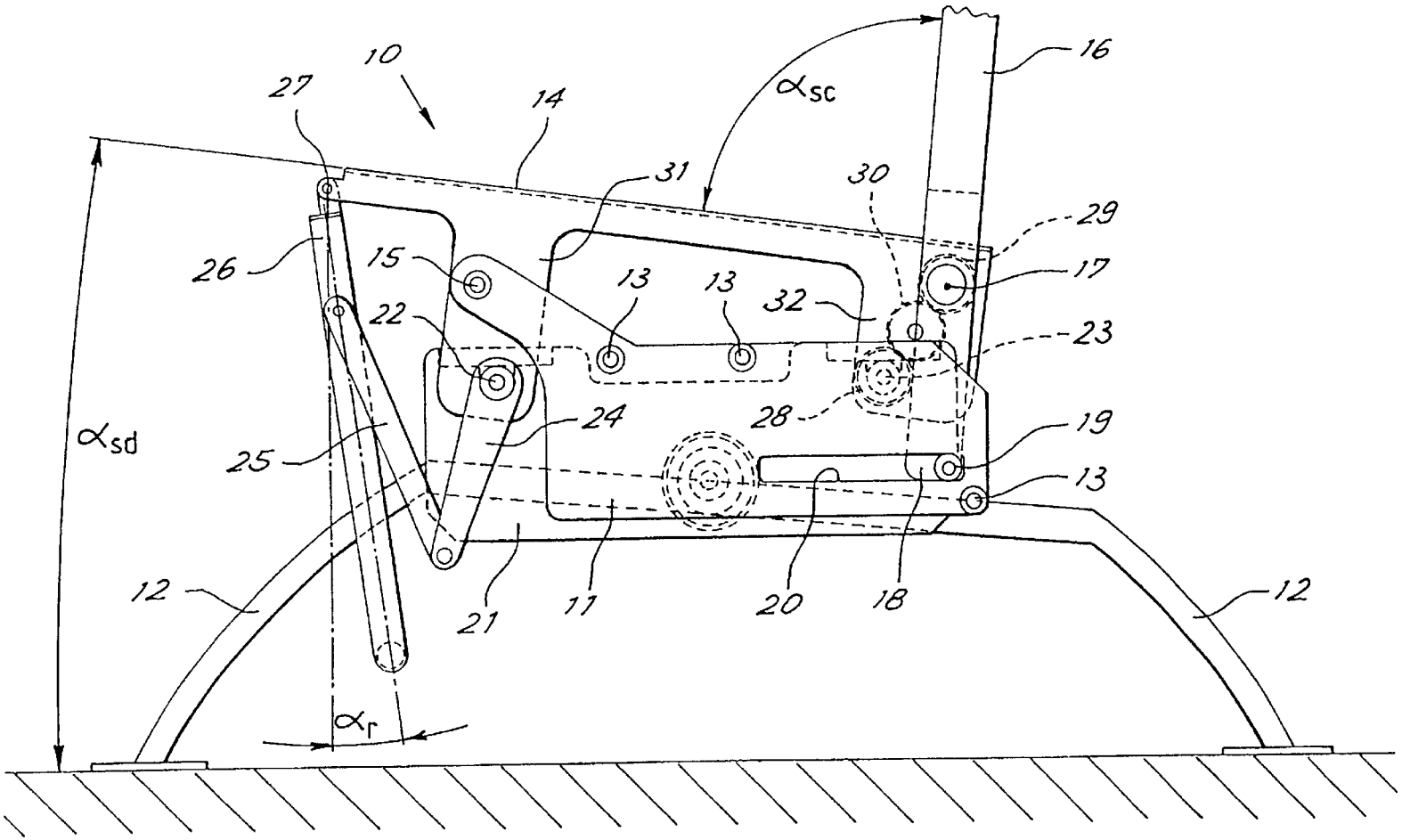
FIG. 1 is a diagrammatic and fragmentary elevation side view of an armchair in accordance with the invention, with footrest and back in a first position.

With reference to the drawings, an armchair is shown which is generally denoted by 10 and made in accordance with the invention.

Only one side of the armchair is shown in the figures, the other side substantially being a mirror image of the first one.

The armchair 10 comprises a base frame, essentially formed of a pair of side shoulders 11 and pairs of front and rear legs 12. The side shoulders (only one of which is shown) are interconnected by crosspieces 13 for frame stiffening. A base seat 14 is pivotally mounted at the front to the side shoulders 11 according to a transverse axis 15. At the rear, the base seat is pivotally mounted to a back 16 according to a transverse axis 17. Advantageously, a footrest 26 is pivotally mounted to the base seat according to an axis 27.

The back has extensions 18 extending downwardly past axis 17 for coupling with the frame in a horizontally slidable manner. According to a preferred embodiment, coupling is obtained by pins or runners 19 laterally projecting from the extensions for insertion into horizontal slits 20 present in the side shoulders.

Advantageously, the movement unit of the armchair is embodied by a substantially known dual motor 21, hanging from the base seat for moving therewith.

Yet advantageously, the motor is suspended from the base seat at its two power-driven shafts 22, 23. For the purpose, the base seat has pairs of front and rear lateral sides 31, 32.

The front shaft 22 is connected to the footrest by a connecting rod-crank connection 24, 25, whereas the rear shaft 23 is connected to the rotation axis 17 of the back by a transmission gear formed of a pair of gears 28, 29 (integral with the driving shaft and the back, respectively) between which a third gear 30 is present which is supported in a freely rotatable manner on the base seat side. The rotation axis 15 of the base seat is placed between the base seat surface and the front driving shaft 22.

Shown in FIG. 1 is the armchair with its back in the vertical position and its footrest completely lowered. In such a position between the back and the base seat there is a first angle $\alpha_{sc}$, of 87° for example, and between the base seat and the horizontal surface there is a first angle $\alpha_{sd}$, of 8° for example.

The footrest can be advantageously moved backward towards the inside of the armchair by an angle $\alpha_r$ of 3.5° for example, relative to the vertical.

Figure 2:
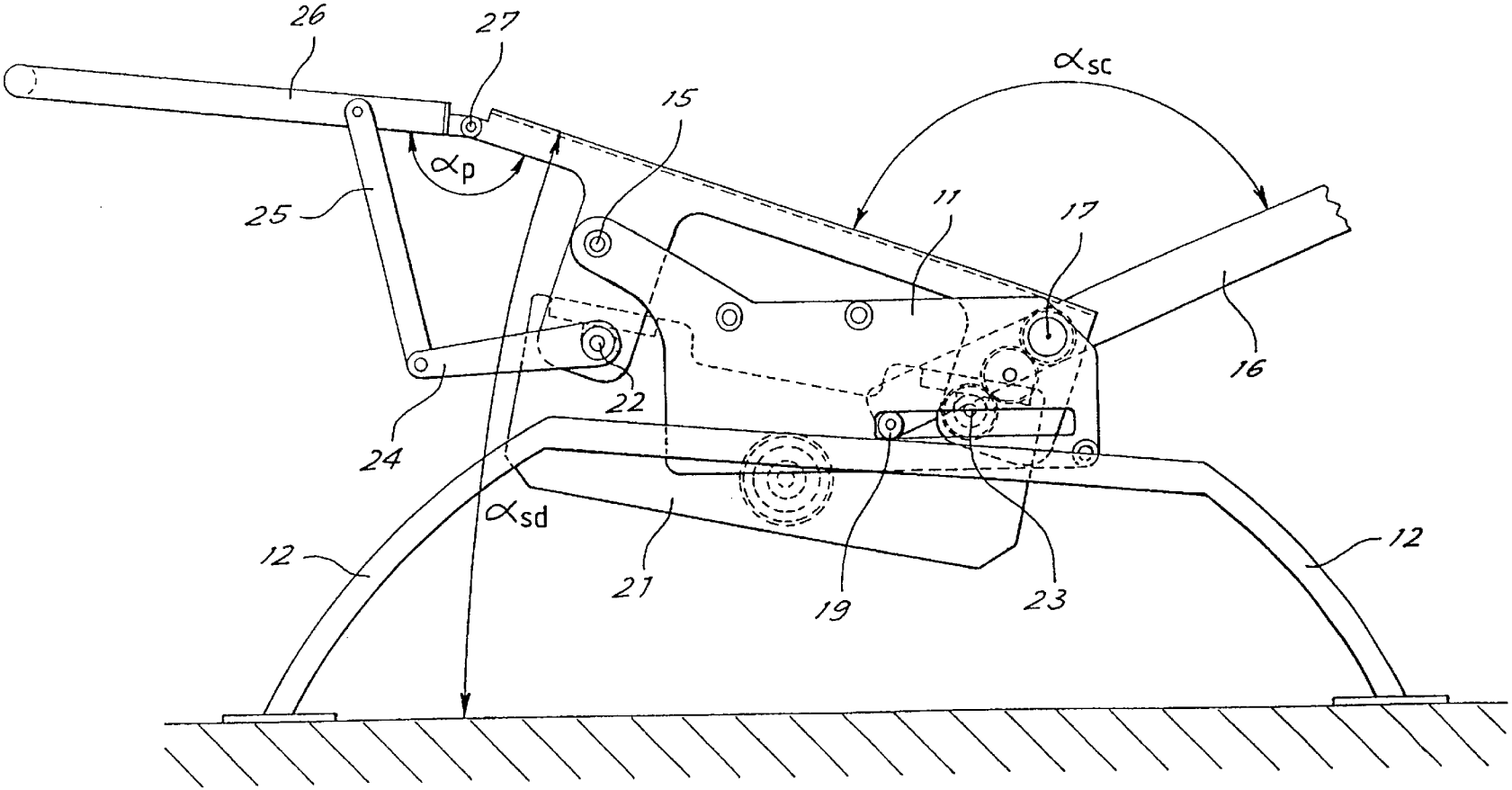
FIG. 2 represents a view similar to that in FIG. 1, but with footrest and back in a second position.

As viewed from FIG. 2, by operating the power-driven rear shaft 23, the back rotates downwardly about axis 17. The corresponding sliding of the lower runner 19 and consequent lowering of axis 17, cause a simultaneous rotation of the base seat in the same way as the back, but about axis 15. When the back is completely lowered, angle $\alpha_{sc}$ between the back and the base seat is equal to 137° for example, the base seat having an angle asd going from 8° to 19.5°, for example.

As still shown in FIG. 2, by operating the front driving shaft 22 the footrest 26 can be raised in an independent manner for decreasing angle $\alpha_p$ between the footrest itself and the base seat, until a position of maximum lifting is reached in which angle $\alpha_p$ is of 166.5°, for example. When the back is completely lowered, there is therefore an angle of 6° for example, between the base seat and the horizontal surface.

At this point it is apparent that the intended purposes have been achieved.

Due to the movement of the base seat being linked to the back rotation, the kinematic mechanisms are simplified and the footrest movement is made independent, and in addition there is always an appropriate angle between the base seat and the back even without possibly moving the footrest. Since the base seat tilts on inclination of the back, the armchair is made much more comfortable and too much stress at the lumbar region is avoided.

Furthermore, movement of the motor with the base seat enables a smaller angle of rotation of the driving shaft to be required for completely lifting the footrest, as compared with the case of a motor fixed to the frame. Obviously, the above description of an embodiment applying the innovatory principles of the present invention is for purposes of illustration only and therefore must not be considered as a limitation of the scope of the invention as herein claimed.

For example, the armchair structure can be upholstered as preferred. Proportions of the parts and movement limits too can be varied depending on specific requirements.

What is claimed is:

1. An armchair (10) comprising a spport frame (11,12) having mounted thereon power-driven movement means (21), and a base seat (14) and a back (16) movable between a first and second positions by said power-driven movement Beans (21), and characterized in that the base seat (14) is pivotally mounted adjacent a front end thereof to the support frame to rotate about a first transverse axis (15), the back (16) being pivotally mounted to the base seat (14) adjacent the rear thereof to rotate about a second transverse axis (17), the back (16) having extensions (18) extending at lower ends thereof downwardly past said second axis (17) and having said lower ends constrained to slide in elongate slots in said frame, so that on rotation of the back about said second axis (17), the base seat is caused to rotate in the same way about said first axis (15).

2. An armchair as claimed in claim 1, including means suspending the power-driven means (21) from said base seat (14) to be movable therewith.

3. An armchair as claimed in claim 2, characterized in that a power-driven footrest (26) is pivotally mounted to the base seat adjacent said front end thereof, the power-driven means being formed as a single power unit (21) having two independent driving shafts (22, 23), a first of said two driving shaft being close to the footrest (26) and connected thereto in a kinematic manner for controlling movement thereof and a second of said two shafts being close to the back (16) and connected in a kinematic manner to the back and the base seat for effecting simultaneous movement thereof.

4. An armchair as claimed in claim 3, characterized in that the power unit has a generally elongated shape in a longitudinal direction of the base seat (14), the two shafts being disposed close to the front portion and the rear portion, respectively, of said unit.

5. An armchair as claimed in claim 3, characterized in that between the second driving shaft (23) and the rotation axis (17) of the back, a transmission gear 30 is present between and meshed with a first gear (28) fitted on the second driving shaft (23) and another gear (29) fitted on the rotation axis (17) of the back.

6. An armchair as claimed in claim 3, characterized in that between the first driving shaft (22) and the footrest (26) a kinematic connecting rod-crank mechanism (24, 25) is present for effecting movement of the footrest.

7. An armchair as claimed in claim 3, characterized in that the power unit (21) is suspended from the base seat (14) at the two driving shafts (22, 23).

8. An armchair as claimed in claim 3, characterized in that the first rotation axis (15) of the base seat is placed between the base seat surface and the front driving shaft.

9. An armchair as claimed in claim 1, characterized in that a power-driven footrest (26) is pivotally mounted to the base seat adjacent said front end thereof.

10. An armchair as claimed in claim 1, characterized in that said lower ends of the extensions (18) are constrained in said slots by means of runners (19) sliding along horizontal slits (20) formed in side shoulders (11) of the support frame.

* * * * *